United States Patent [19]

Krumpelt et al.

[11] 4,127,457

[45] Nov. 28, 1978

[54] METHOD OF REDUCING CHLORATE FORMATION IN A CHLOR-ALKALI ELECTROLYTIC CELL

[75] Inventors: Michael Krumpelt, Riverview; Stanley T. Hirozawa, Birmingham, both of Mich.

[73] Assignee: BASF Wyandotte Corporation, Wyandotte, Mich.

[21] Appl. No.: 882,367

[22] Filed: Mar. 1, 1978

Related U.S. Application Data

[63] Continuation-in-part of Ser. No. 751,845, Dec. 17, 1976, abandoned.

[51] Int. Cl.[2] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,773,634 | 11/1973 | Stacey et al. | 204/98 |
| 3,878,072 | 4/1975 | Cook et al. | 204/98 |
| 3,948,737 | 4/1976 | Cook et al. | 204/98 |
| 3,954,579 | 5/1976 | Cook et al. | 204/98 |
| 4,025,405 | 5/1977 | Dotson et al. | 204/98 |

*Primary Examiner*—R. L. Andrews

*Attorney, Agent, or Firm*—Andrew E. Pierce; Bernhard R. Swick; Robert E. Dunn

[57] ABSTRACT

In a chlor-alkali electrolytic cell in which an aqueous alkali metal chloride solution is electrolyzed, said electrolytic cell having an anode compartment containing an anode and a cathode compartment containing a cathode separated by a substantially fluid impervious membrane barrier consisting of a copolymer of tetrafluoroethylene and a sulfonated perfluorovinyl ether, the formation of alkali metal chlorates in the anode compartment is reduced by operating the chlor-alkali cell at high salt conversions greater than 40% and preferably between about 60% and about 80% conversion.

7 Claims, No Drawings

METHOD OF REDUCING CHLORATE FORMATION IN A CHLOR-ALKALI ELECTROLYTIC CELL

CROSS REFERENCE TO RELATED APPLICATION

This application is a continuation-in-part of the applicants' prior copending application, Ser. No. 751,845, filed Dec. 17, 1976, now abandoned.

BACKGROUND OF THE INVENTION

1. Field of the Invention

This invention relates to electrolysis of aqueous alkali metal chloride solutions.

2. Description of the Prior Art

The electrolysis of an aqueous alkali metal chloride solution has as its primary products chlorine and alkali metal hydroxide. A secondary product is alkali metal chlorate. Generally, chlorate formation is considered unfavorable except where the chlorate is desired to be recovered as a by-product of the electrolysis reaction.

In prior art electrolytic cells equipped with a selectively permeable membrane barrier between the anode and cathode compartments of said electrolytic cell, it was believed that chlorate formation was dependent upon the amount of hydroxide ion migrating from the cathode compartment to the anode compartment since chlorate formation occurs in the anolyte according to the following equation:

$$3OH^- + 3Cl_2 \rightarrow 3Cl^- + 2HCl + HClO_3$$

It was believed that since the migration of hydroxide ion from the catholyte across the membrane into the anolyte depends primarily upon the alkali metal hydroxide concentration in the catholyte that reducing the amount of hydroxide ion migrating into the anolyte by operating the electrolytic cell at a low concentration of alkali metal hydroxide in the catholyte would reduce alkali metal chlorate formation in the anolyte.

Actually the formation of chlorates proceeds in two steps. In the first step, hypochlorous acid is formed by an equilibrium reaction:

$$Cl_2 + H_2O \rightleftharpoons HCl + HClO$$

In the second step, the hypochlorous acid disproportionates to chlorate and chloride in accordance with the following equation:

$$3HClO + 3NaOH \rightarrow NaClO_3 + 2NaCl + 3H_2O$$

The second reaction is irreversible and rate determining.

In the first reaction, as can be seen, the formation of hypochlorous acid and hence chlorates would be suppressed by the addition of HCl to the anolyte. It is known to maintain the pH of the anolyte at a pH of less than 3 by the addition of hydrochloric acid so as to suppress chlorate formation. This is taught in U.S. Pat. No. 3,948,737. In this patent there is disclosed a process for the electrolysis of brine in which the formation of sodium chlorate in the anolyte is minimized preferably by maintaining the pH of the brine solution in the anolyte within the range of about 2.5 to 4. In this patent there is also disclosed the introduction of water into the catholyte so as to maintain the sodium hydroxide concentration of the catholyte not in excess of about 33% by weight.

In the prior art electrolytic cells utilizing an asbestos diaphragm as a barrier separating the anode compartment from the cathode compartment, the migration of hydroxide ions from the cathode compartment to the anode compartment is counteracted by the steady hydraulic flow of anolyte liquid across the diaphragm so as to effect a backwashing of the hydroxide ions away from the diaphragm thus tending to keep the hydroxide ions in the cathode compartment where they are formed. In the diaphragm cells, the formation of chlorates can be kept at a minimum by properly choosing the cell operating conditions such that by maintaining the salt conversion in the anolyte at a concentration of 50% or below, adequate reduction in chlorate formation is effected. For instance, at 50% alkali metal chloride conversion in the anolyte compartment of the diaphragm cell, the formation of chlorate is 0.25 gram per liter. As the salt conversion in the anolyte is increased to 55%, the chlorate formation increases to 0.5 gram per liter and upon increasing the salt conversion beyond 55% the chlorate formation increases very rapidly.

It is known that in a cell specifically designed to produce alkali metal chlorates, the anolyte and catholyte are mixed, thus dispensing with the diaphragm or mercury cathode of prior art chlor-alkali electrolytic cells. For instance, U.S. Pat. No. 3,623,967 discloses an electrolytic apparatus for the production of alkali metal chlorate.

In the membrane-type electrolytic cells for the electrolysis of brine to produce chlorine and sodium hydroxide, a so-called "perm-selective" barrier is used consisting, for instance, of a hydrolyzed copolymer of tetrafluoroethylene and a sulfonated perfluorovinyl ether. Such polymers are disclosed in U.S. Pat. No. 3,282,875.

Other membranes have been developed, specifically the perfluorocarboxylic acid type membrane of Asahi Chemical Industry Company, Limited, and the hydrocarbon type cation exchange membrane. Modification of these and other ion exchange membranes are currently being made. The copolymers of tetrafluoroethylene and sulfonyl fluoride perfluorovinyl ether utilized as an ion exchange membrane in such electrolysis cells are sold under the trademark "Nafion."

SUMMARY OF THE INVENTION

In a process for the electrolysis of alkali metal chlorides to produce chlorine and alkali metal hydroxide in a membrane-type chlor-alkali cell utilizing a membrane made of a copolymer of tetrafluoroethylene and a sulfonated perfluorovinyl ether, the rate of chlorate formation in the anolyte of said cell can be substantially reduced by operating said cell at high salt conversions rather than at the usual low salt conversion conditions customarily employed. By shifting the degree of salt conversion from about 40% to salt conversions of over 75%, current efficiencies remain constant for the production of alkali metal hydroxide while chlorate formation is decreased and oxygen formation is increased. The process of the invention provides economies in that a lower quantity of fluid is recycled in the process thus permitting the use of smaller capacity tanks and pumps.

DETAILED DESCRIPTION OF THE INVENTION

The present invention is practiced using membrane-type chlor-alkali cells for the electrolysis of brine to produce alkali metal hydroxide, chlorine and hydrogen. While any suitable membrane can be used, the present invention is preferably practiced using membranes that are made of a copolymer of tetrafluoroethylene and a sulfonated perfluorovinyl ether such as a copolymer of tetrafluoroethylene and sulfonyl fluoride perfluorovinyl ether. Such membrane materials are sold under the trademark "Nafion" for use in such membrane-type chlor-alkali cells. The membranes ordinarily have a thickness on the order of 0.10 to 0.4 millimeter and the polymer has an equivalent weight number of about 1000 to about 1500. It is customary in such cells to utilize dimensionally stable anodes so that the potentially long useful life of the membrane materials described above, which can be as long as about 3 years, may be taken advantage of.

In the practice of the invention where reaction in the anolyte of a chlor-alkali cell of the secondary product alkali metal chlorate is desired, the chlor-alkali cell is operated under conditions such that the degree of salt conversion in the anolyte is maintained at from about 40% to about 80%, preferably about 60% to about 80%. No addition of HCl to the anolyte is required to minimize chlorate formation where said salt conversion is maintained in the process of the invention.

Since in the prior art diaphragm type chlor-alkali cells it has been found that the rate of chlorate formation in the anolyte can be kept low by operating the cell at salt conversions of 50% or less, it is unexpected that a reduced rate of chlorate formation in the process of the invention, in which a membrane-type chlor-alkali cell is utilized, can be obtained by increasing the degree of conversion of the alkali metal salt in solution in the anolyte of said cell.

The concentration of sodium chloride in a charge to the anolyte of the chlor-alkali cell is generally about 250 to about 340 grams per liter and, as indicated above, this concentration will be reduced to about 120 to about 230 grams per liter by operating the cell at a salt conversion between 40% and 80%. The sodium chloride concentrations in the effluent are higher than would be expected by calculation because of the water flow across the cell membrane as water of hydration of sodium ions. As much as 4 to 5 moles of water pass across the membrane per sodium ion.

It is an object of the present invention to substantially reduce the rate of chlorate formation in the anolyte of the chlor-alkali membrane-type cell while at the same time maintaining a high current efficiency for the production of alkali metal hydroxides in the cell. It has been found that high current efficiencies can be maintained in the cell while at the same time operating at high salt conversions of between about 60% to about 80% required to obtain the reduction in chlorate formation. As is conventional, the alkali metal chloride brine containing preferably about 300 to about 340 grams per liter is continuously circulated through the anode compartment of the cell.

More specifically, in the practice of the method in the present invention an aqueous solution of an alkali metal chloride, i.e., sodium chloride is electrolyzed in the chlor-alkali cell having an anode compartment containing an anode and a cathode compartment containing a cathode. The compartments are separated by a barrier membrane which is substantially impervious to fluids and gases but which is selectively permeable so as to allow the passage of cations (positively charged ions) and inhibit the passage of anions (negatively charged ions). The selectively permeable membrane can be described as only substantially impervious to fluids, gases and various ions since the membrane will pass a certain number of anions (hydroxyl ions) through the membrane in the direction of the anode and a certain amount of water as hydration water of the $Na^+$ ion. The number of anions passing through the membrane determines the electrolysis efficiency or electrical energy required to produce a given amount of chlorine or caustic. In addition, the concentration of sodium hydroxide in the cathode compartment has an effect on the migration of hydroxyl ion through the membrane toward the anode of the cell.

In the operation of the chlor-alkali cell, water is introduced into the cathode compartment of the cell. The rate at which the water is added to the cathode compartment and the rate at which the catholyte liquor is removed from the compartment are controlled such that the catholyte liquor generally has an alkali metal hydroxide concentration generally of about 15 percent to about 20 percent by weight.

In general, the process may be operated over a wide temperature range, temperatures from room temperature up to the boiling point of the electrolyte being typical although temperatures from about 80° C. to 90° C. are preferred. Similarly, the electrical operating conditions can also vary over a wide range, cell voltages are generally from about 2.9 to 5 volts and current densities generally from about 0.75 to 3 amperes per square inch. In the operation of the process, however, it is found that for any given current density used, power consumption of the cell will not be reduced where brine conversions of from 40% to 80% in the anolyte are utilized.

The electrolytic cells in which the process of the present invention can be carried out are formed of any suitable electrically non-conductive material having resistance to chlorine, hydrochloric acid and sodium hydroxide at the temperatures at which the cell is operated. Suitable materials have been found to be chlorinated polyvinyl chloride, polypropylene containing up to 20% of an inert fibrous filler, chlorendic acid based polyester resins and the like. Preferably, the materials of construction used for the cell have sufficiently rigidity to be self-supporting. In certain instance, the chlor-alkali cells can be formed of material which does not meet the above requirements. For instance, concrete or cement while not being resistant to hydrochloric acid and chlorine can be used if the interior and exposed areas of such material are coated with a material which will provide the necessary resistance. Where materials are utilized for cell construction which are only substantially self-supporting, it may be desirable, especially where relatively large installations are used, to reinforce the exterior of the cell using metal bands or other means of support to provide additional rigidity.

The electrodes of the cell can be any conventional electrode used in diaphragm or membrane-type chlor-alkali cells. However, as previously described hereinabove, preferably the anode material is a dimensionally stable electrode which can be further described as having a titanium substrate coated with an activating coating containing at least one material selected from the platinum group metals and platinum group oxides. The metallic anodes which are preferably ruthenium coated titanium electrodes can also be formed by coating a titanium substrate with an electrically active coating such as a coating of one or more platinum group metals or platinum group metal oxides. In the most preferred embodiment, the titanium substrate has an electrically active coating containing ruthenium oxide and a conductive metal core below the titanium substrate which can be steel, copper or aluminum or the like.

Typically, the cathodes can be constructed of steel and preferably have a nickel coating, although iron, graphite or other resistant materials can also be used.

The preferred nickel coated cathodes can be prepared in accordance with copending application Ser. No. 658,538, filed Feb. 17, 1976 in the U.S. Patent Office, incorporated herein by reference. By the process of this application, a steel cathode can be coated with a dense non-porous electroless nickel coating by immersing said steel cathode in a bath at a suitable temperature, the bath containing a suitable nickel salt, water, a complexing agent and a reducing agent. Considerable savings in power in the electrolysis of brine in a chlor-alkali cell are achieved by the use of such electrodes.

The preferred nickel coated cathodes can also be prepared in accordance with copending application Ser. No. 611,030, filed Sep. 8, 1975 in the U.S. Patent Office, incorporated herein by reference. By the process of this application, a steel cathode can be coated with nickel by either flame spraying or plasma spraying the power metal onto the steel cathode surface.

The compartments of the chlor-alkali cell utilized in the process of the invention are separated by any suitable cation exchange membrane, preferably the hydrolyzed copolymer of tetrafluoroethylene and a sulfonated perfluorovinyl ether. Such materials are sold under the trademark "Nafion" and have structural units of the formula:

$$\left[(CF_2)_n-\underset{\substack{|\\ O-CF_2-CF(CF_3)-O-CF_2-CF_2-SO_3H}}{CF}\right]$$

This copolymer has an equivalent weight of from about 900 to 1600, preferably from about 1000 to about 1500. Such copolymers are prepared, as disclosed in U.S. Pat. No. 3,282,875, by reacting at a temperature below about 110° C. a perfluorovinyl ether with tetrafluoroethylene in an aqueous liquid phase, preferably at a pH below 8 in the presence of a free radical initiator such as ammonium persulfate. Subsequently, the acyl fluoride groups of the copolymer are hydrolyzed to the free acid or salt form using conventional means. Other ion exchange membranes can be used which are resistant to the heat and corrosive conditions exhibited in such cells. These membranes are utilized in the form of a thin film which can be deposited on an inert support such as a cloth woven of polytetrafluoroethylene, or the like or can have a thickness which can be varied over a considerable range, generally thicknesses of from about 0.1 to about 0.4 millimeter being typical. Preferably, the membrane is a composite of a 0.038 millimeter coating of said copolymer having an equivalent weight of 1500 on one side of said woven polytetrafluoroethylene cloth and a 0.1 millimeter to 0.13 millimeter coating of said copolymer having an equivalent weight of 1100 on the opposite side of said woven cloth. The membrane can be fabricated in any desired shape. The copolymer sold under the trade name of "Nafion" is preferably fabricated to the desired dimension in the form of the sulfonyl fluoride. In this non-acid form, the copolymer is soft and pliable and can be heat-sealed to form strong bonds. Following shaping or forming to the desired configuration, the material is hydrolyzed. The sulfonyl fluoride groups are converted to free sulfonic acid or sodium sulfonate groups. Hydrolysis can be effected by boiling the membrane in water or alternatively in caustic alkali solution.

After the hydrolysis step described above, the cell membrane is desirably subjected to a heat treatment at 100° C. to 275° C. for a period of several hours to 4 minutes so as to provide improved selectivity and higher current efficiency, i.e., lower energy consumption per unit of product obtained from the chlor-alkali cell. In addition, the aqueous alkali metal hydroxide solution is obtained having a lower salt concentration when the membrane is treated in this manner. The treatment can consist of placing the membrane between electrically heated flat plates or in an oven where said membrane is suitably protected by placing slightly larger thin sheets of polytetrafluoroethylene, for instance, on either side of the membrane. Satisfactory results have been obtained in the treatment where no pressure has been exerted on the membrane during the heat treatment but it is desirable to use a small pressure on the membrane during the heat treatment step. The duration of the heat treatment is dependent upon the temperature used for the treatment and can be as short a time as 4 to 5 minutes where a temperature of 275° C. is utilized. Further details of the heat treatment of the membranes used in the practice of the present invention are disclosed in copending applications, Ser. No. 619,606, filed Oct. 6, 1975 and Ser. No. 729,201, filed Oct. 4, 1976 and incorporated herein by reference.

The following examples illustrate the various aspects of the invention but are not intended to be limiting. Where not otherwise specified throughout the specification and claims, temperatures are given in degrees centigrade and parts are by weight.

EXAMPLES 1, 2 and 3

A saturated solution of sodium chloride was introduced into the anode compartment of a two-compartment electrolytic cell containing a ruthenium oxide coated titanium mesh anode and a steel mesh cathode separated from the anode by a cation active selectively permeable diaphragm of 116 square centimeters effective area having a total film thickness of 0.2 millimeter and being composed of a 0.1 millimeter layer of a copolymer of tetrafluoroethylene and sulfonated perfluorovinyl ether having an equivalent weight of about 1100 and a 0.05 millimeter layer having an equivalent weight of 1500, said polymers prepared according to U.S. Pat. No. 3,282,875. The membrane was utilized without heat conditioning to improve selectivity. The cathode compartment was initially filled with dilute aqueous sodium hydroxide at a concentration of 80 grams per liter and water added subsequently to maintain a sodium hydroxide concentration of 19%. Chlorine gas evolved from the anode compartment was vented through a pipe and hydrogen evolved at the cathode was separately vented from the cathode compartment. A pipe for removal of caustic liquor was located in the cathode compartment. A temperature of about 80° C. was maintained in the cell which was operated at a current density of about 1.4 amperes per square inch of membrane. Samples of the anolyte liquor were taken at intervals and analyzed for sodium chloride and sodium chlorate. Current efficiencies for sodium hydroxide, sodium chlorate and oxygen were calculated for each level of salt conversion (i.e., 40%, 53% and 93%) and sodium chlorate formation. The data from this run are set out in Table I.

Table I

| Example No. | Salt Conversion (%) | Rate of Chlorate Formation (Moles/Hour) | Current Efficiencies NaOH (%) | $NaClO_3$ (%) | $O_2$ (%) |
|---|---|---|---|---|---|
| 1 | 40 | $24.0 \times 10^{-3}$ | 76.3 | 19.2 | 5.3 |
| 2 | 53 | $20.9 \times 10^{-3}$ | 75.6 | 15.4 | 6.6 |
| 3 | 93 | $9.2 \times 10^{-3}$ | 75.6 | 6.2 | 14.5 |

EXAMPLES 4–7

Following the procedure of Examples 1, 2 and 3, a saturated solution of sodium chloride was subjected to electrolysis in an electrolytic cell. The selectively permeable membrane utilized in the cell was subjected to a heat treatment prior to use at a temperature of 200° C. for a period of 2 hours in order to provide improved selectivity, exhibit higher current efficiency and lower energy consumption per unit of product. The procedure followed was in accordance with the procedure described in copending applications, Ser. No. 619,606, filed Oct. 6, 1975 and Ser. No. 729,201, filed Oct. 4, 1976. The conditions of electrolysis were similar to those described in Examples 1 through 3. The results are set out in Table II.

Table II

| Example No. | Salt Conversion (%) | Rate of Chlorate Formation (Moles/Hour) | Current Efficiencies NaOH (%) | $NaClO_3$ (%) | $O_2$ (%) |
|---|---|---|---|---|---|
| 4 | 24 | $2.03 \times 10^{-3}$ | 90.7 | 1.3 | 5.6 |
| 5 | 46 | $1.01 \times 10^{-3}$ | 92.2 | .7 | 6.1 |
| 6 | 47 | $1.03 \times 10^{-3}$ | 91.2 | .7 | 7.2 |
| 7 | 85 | $.48 \times 10^{-3}$ | 89.9 | .3 | 9.5 |

These data indicate that the rate of chlorate formation in the electrolysis of a sodium chloride brine can be substantially reduced by operating the chlor-alkali cell at a salt conversion percentage in the anolyte compartment of about 60% to about 80%. The data also indicate that the rate of chlorate formation can be substantially reduced when a selectively permeable membrane composed of a copolymer of tetrafluoroethylene and sulfonate perfluorovinyl ether is subjected to a heat treatment step prior to its use in order to increase selectivity of the membrane.

EXAMPLE 8

This example illustrates the use of an electroless nickel coated cathode in a chlor-alkali electrolytic cell which is operated so as to obtain reduced alkali metal chlorate formation in the anode compartment of said cell.

The cathode used is a steel mesh cathode which is coated with nickel by immersing said steel mesh cathode in a bath containing nickel chloride, water, a complexing agent and a reducing agent all in accordance with the teaching of copending application, Ser. No. 658,538, filed Feb. 17, 1976. The procedure and remaining conditions of Example 1 are used except that the single layered membrane used has an equivalent weight of 1350 and a film thickness of 0.1 millimeter. At a salt conversion of 70%, the rate of chlorate formation is about $22 \times 10^{-3}$ moles per hour.

EXAMPLE 9

This example illustrates the use of a plasma spraying technique to form a nickel coated steel cathode for use in the chlor-alkali electrolytic cell of the invention.

The steel mesh cathode is coated with nickel by plasma spraying. In this process of plasma spraying a plasma is obtained by passing a gas through an electric arc discharge. A powder metal is admixed with the plasma. Thus using a plasma spraying process a nickel coating is obtained on the steel mesh cathode in accordance with the teaching of copending application, Ser. No. 611,030, filed Sept. 8, 1975. The procedure and remaining conditions of Example 1 are used except that a single layered membrane is used having a thickness of 0.25 millimeter and an equivalent weight of 1200. At a salt conversion of 50%, the rate of chlorate formation is about $25 \times 10^{-3}$ moles per hour.

While this invention has been described with reference to certain specific embodiments, it will be recognized by those skilled in the art that many variations are possible without departing from the scope and spirit of the invention.

What is claimed is:

1. In a process wherein an aqueous alkali metal chloride solution is electrolyzed in an electrolytic cell having an anode compartment containing an anode and anolyte and a cathode compartment containing a cathode and catholyte and a substantially fluid impervious selectively permeable barrier separating the anode and cathode compartments and wherein said alkali metal chloride solution is continuously circulated through said anode compartment, the improvement comprising reducing chlorate formation in said anolyte by introducing an alkali metal chloride solution into said anode compartment and operating said cell at an alkali metal chloride conversion factor of between 40% and 80% and removing alkali metal hydroxide from said cathode compartment so as to maintain an alkali metal hydroxide concentration of about 15 percent to about 20 percent by weight.

2. The process of claim 1 wherein said selectively permeable barrier consists essentially of a hydrolyzed copolymer of tetrafluoroethylene and a sulfonated perfluorovinyl ether having an equivalent weight number of about 1000 to about 1500 and a thickness of 0.1 to 0.4 millimeter.

3. The process of claim 1 wherein said alkali metal chloride is sodium chloride and said alkali metal hydroxide is sodium hydroxide.

4. The process of claim 3 wherein said anode comprises a titanium substrate coated with an activating coating containing at least one material selected from the platinum group metals and the platinum group oxides.

5. The process of claim 4 wherein said cathode comprises a steel substrate coated with nickel by a plasma spraying process.

6. The process of claim 5 wherein said anode comprises a ruthenium activating coating.

7. The process of claim 4 wherein said cathode comprises a steel substrate coated with nickel by an electroless coating process.

* * * * *